US006433807B1

(12) United States Patent
Francis et al.

(10) Patent No.: US 6,433,807 B1
(45) Date of Patent: Aug. 13, 2002

(54) THERMAL PRINTHEAD COMPENSATION

(75) Inventors: Robert E. Francis, Richfield; Gary M. Klinefelter, Eden Prairie, both of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/702,930

(22) Filed: Oct. 31, 2000

Related U.S. Application Data

(60) Provisional application No. 60/165,358, filed on Nov. 12, 1999.

(51) Int. Cl.[7] ..... B41J 2/36
(52) U.S. Cl. ..... 347/195
(58) Field of Search ..... 347/188, 195; 400/120.15

(56) References Cited

U.S. PATENT DOCUMENTS

| | | | | |
|---|---|---|---|---|
| 4,168,421 | A | 9/1979 | Ito | 219/216 |
| 4,284,876 | A | 8/1981 | Ishibashi et al. | 219/216 |
| 4,567,488 | A | 1/1986 | Moriguchi et al. | 346/76 |
| 4,709,149 | A | 11/1987 | Takahashi et al. | 250/317.1 |
| 4,769,527 | A | 9/1988 | Hart et al. | 219/216 |
| 4,888,601 | A | 12/1989 | Inui | 346/76 |
| 5,120,936 | A | 6/1992 | Shyu et al. | 219/497 |
| 5,170,179 | A | 12/1992 | Chen et al. | 346/76 |
| 5,220,349 | A | 6/1993 | Saita et al. | 346/76 |
| 5,308,958 | A | 5/1994 | Gassho | 219/486 |
| 5,424,767 | A | 6/1995 | Alavizadeh et al. | 347/17 |
| 5,636,331 | A | 6/1997 | Klinefelter et al. | 395/109 |
| 5,793,403 | A | 8/1998 | Klinefelter et al. | 347/195 |
| 5,956,067 | A | 9/1999 | Isono et al. | 347/176 |

FOREIGN PATENT DOCUMENTS

| | | |
|---|---|---|
| JP | 63125357 | 5/1988 |
| JP | 2870574 | 3/1999 |

OTHER PUBLICATIONS

U.S. Provisional Patent Application of Robert E. Francis and Gary M. Klinefelter ser. No. 60/165,358, filed Nov. 12, 1999, entitled "Thermal Printhead Compensation".

*Primary Examiner*—Huan Tran
(74) *Attorney, Agent, or Firm*—Westman, Champlin & Kelly

(57) ABSTRACT

A method for use with an identification card printing system to improve contrast of an original image represented by an array of pixels each having a pixel level representing an intensity of the pixel includes a first step of selecting a pixel of the pixel array. Next, an adjusted pixel level is calculated for the selected pixel based upon its pixel level and at least one proximal pixel level defined as the pixel level of a pixel located proximate to the selected pixel. Finally, the selecting and calculating steps are repeated for substantially all of the pixels of the pixel array to form an adjusted pixel array that represents an adjusted image having greater contrast than the original image.

9 Claims, 5 Drawing Sheets

THERMAL PRINTHEAD COMPENSATION

CROSS REFERENCE TO RELATED APPLICATION

This Application claims benefit of U.S. Provisional Patent Application No. 60/165,358, entitled "THERMAL PRINTHEAD COMPENSATION," filed on Nov. 12, 1999.

FIELD OF THE INVENTION

The present invention relates to identification card printing systems adapted to print an image, corresponding to an image file, onto card substrates. More particularly, the present invention relates to adjusting the image file to improve the contrast of the image.

BACKGROUND OF THE INVENTION

Identification cards are widely used to carry information typically relating to the cardholder. The use of such identification cards is becoming more and more wide spread and they are used for many purposes, such as drivers' licenses and identification badges. Identification card printing systems are used to print an image, which contains textual and graphical information, on card-like substrates, such as plastic cards.

Identification card printing systems can be thermal based printing systems, which use a thermal printhead to print the desired image that is formed of an array of pixels. Typical thermal printheads include a line of resistive heating elements, each of which can print one pixel of the image at a time. The resistive heating elements are uniformly deposited closely together in a single line having, for example, a resolution of 200 or 300 heaters per inch. A ribbon having primary color panels is positioned between the resistive heating elements and the substrate. When the ribbon is heated by the resistive heating elements, black, white, and colored dye or other material is presented to the substrate to form a pixel at each of the resistive heating elements. The color and gray level (intensity) of the pixels is controlled by an electric current that is selectively and controllably applied to each of the resistive heaters. The array of pixels that form the image is printed on the substrate a line at a time. Each of the lines forms several rows of the pixel array, the number of which corresponds to the number of resistive heating elements used by the printhead.

The sharpness of an image, that is the amount of detail and the maximum contrast between adjacent pixels of the image, is limited by the printhead. Identification card printing systems prefer high contrast and high definition printing to properly present photos and security marks. Unfortunately, low-cost printheads tend to be able to produce only poor contrast images. Consequently, a need exists for a method of improving the contrasts of images printed using identification card printing systems.

SUMMARY OF THE INVENTION

The present invention is directed to a method for use with an identification card printing system to improve contrast of an original image represented by an array of pixels each having a pixel level representing an intensity of the pixel. In general, a pixel of the pixel array is selected and an adjusted pixel level for the selected pixel is calculated based upon its pixel level and at least one proximal pixel level. The proximal pixel level is defined as the pixel level of a pixel located proximate to the selected pixel. Finally, the steps of selecting a pixel and calculating an adjusted pixel level for the selected pixel are repeated for substantially all of the pixels of the pixel array to form an adjusted pixel array that represents an adjusted image having greater contrast than the original image. The present invention is also directed to an identification card printing system that utilizes the above-described method to improve image contrast.

DETAILED DESCRIPTION OF THE PREFERRED EMBODIMENTS

Figure 1:
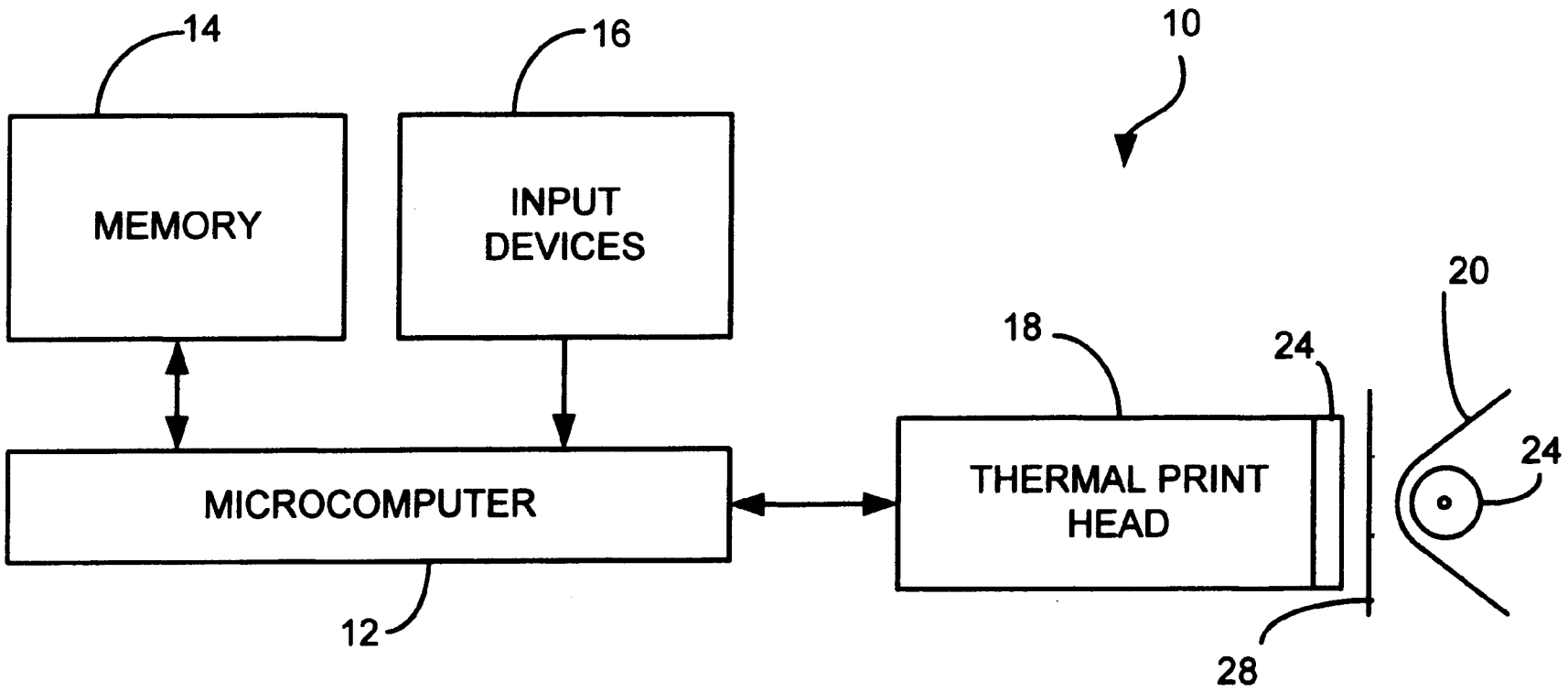
FIG. 1 is a block diagram of an identification card printing system in accordance with embodiments of the invention.

FIG. 1 illustrates an example of an identification card printing system, generally designated as 10, in accordance with one embodiment of the present invention. Printing system 10 generally includes microcomputer 12, memory 14, input devices 16, thermal printhead 18, card substrate (card) 20, and a card feeder mechanism, of which only platen 21 is shown. Printing system 10 is adapted to print text and images onto card 20 using thermal printhead 18. The present invention improves the performance of thermal printhead 18 such that images produced by thermal printhead 18 have greater contrast than would otherwise be possible.

Microcomputer 12 is preferably a microprocessor-based device of a type well-known in the art. However, in other embodiments, microcomputer 12 can be any analog or digital circuitry capable of implementing the method of the present invention. Memory 14 is coupled to microcomputer 12 and can be any of a large variety of conventional data storage devices for temporarily and/or permanently storing data for use by microcomputer 12. In other embodiments, memory 14 can be integrated within microcomputer 12 instead of being a separate device. Microcomputer 12 can be adapted to run a software application that produces image files which can be processed by microcomputer 12. In preferred embodiments, a separate personal computer (not shown) is utilized to process data according to the methods of the present invention. The data or image file is then transferred to a microcomputer 12 for processing of the data and actual control of print head 18.

Input devices 16 are coupled to microcomputer 12 and can be any of a wide variety of devices adapted for providing information and/or control data to microcomputer 12. For instance, input devices 16 can include, for example, a keyboard, a keypad entry device, a sensor, and other types of input devices. Additionally, input devices 16 can include a separate computing system which provides image files to microcomputer 12 for processing, as mentioned above.

Printer driver software, stored in memory 14, is adapted to process an image file from the software application. Alternatively, the printer driver software could be stored in a personal computer that is operating as an input device 16 such that data from the printer driver software can be communicated to microcomputer 12. The image file contains data that represents an original image which is to be printed by printing system 10. The printer driver is used to process the image file and control printhead 18 to print the image. This is accomplished by converting the image of the image file into a pixel array, formed of rows and columns of individual pixels, which represents the image and can be printed with thermal printhead 18 on card 20. Information relating to the pixel array including color and pixel level is provided to microcomputer 12. The pixel level information relates to the gray level or intensity of the pixel. Microcomputer 12 controls thermal printhead 18 to selectively print the pixels of the pixel array on card 20 (FIG. 1) one line at a time in accordance with data or instructions from the printer driver. Each line of the pixel array that is printed by printhead 18, is typically formed of several rows of pixels, the number of which depends on the printhead that is being used.

Figure 2:
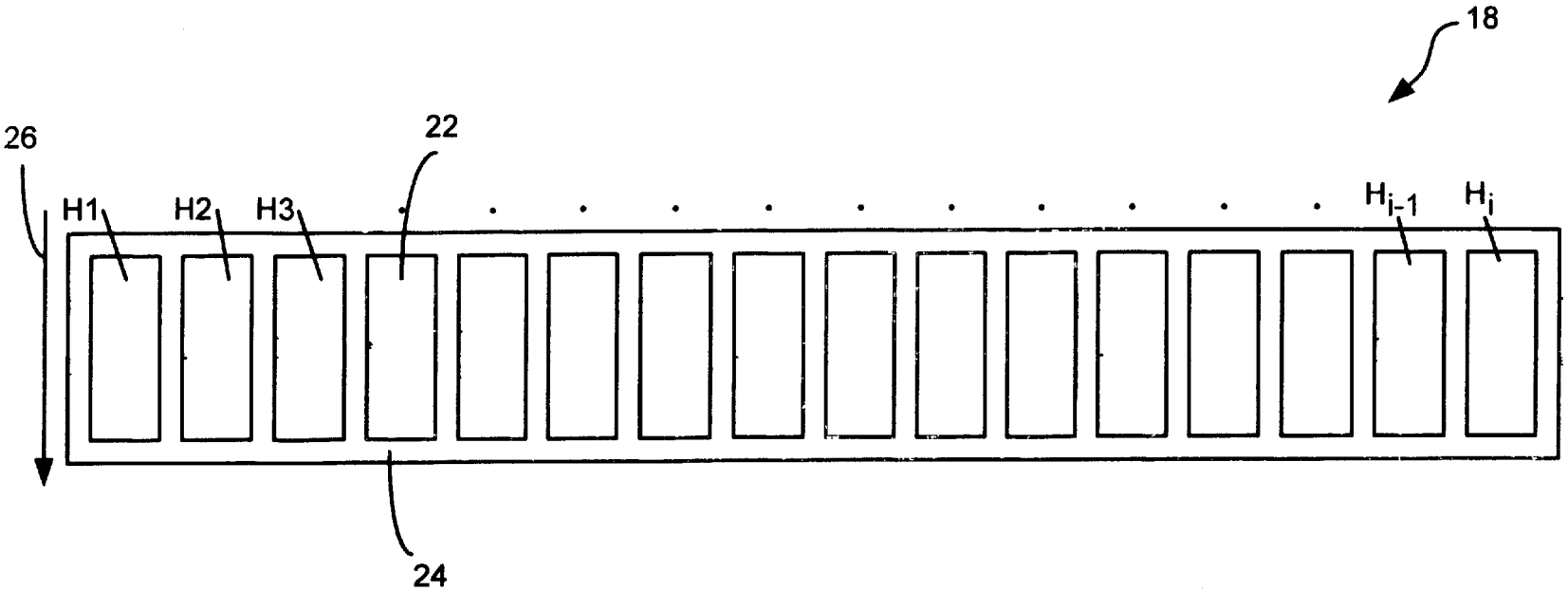
FIG. 2 is a diagrammatic end view of the thermal printhead shown in FIG. 1 in accordance with one embodiment of the invention.

Thermal printhead 18 is of the type well-known in the art having a column of resistive heaters 22 on end 24, as shown in the diagrammatic view of end 24 in FIG. 2. The column of adjacent resistive heaters 22 are designated as $H_i$ through $H_i$ (where i is equal to the number of heaters on thermal printhead 18 and therefore is also equal to the number of rows of pixels per line to be printed on card 20). Thermally sensitive ribbon 28 is positioned between heaters 22 and card 20 and contains a dye which transfers to card 20 when heated while card 20 is moved, relative to thermal printhead 18 in a direction indicated by arrow 26. The amount of dye transferred, or the pixel level of a pixel, is dependent upon the heat applied by the resistive heaters 22. Accordingly, pixels can be printed on card 20 by controllably heating thermally sensitive ribbon 28 with heaters 22. The pixel level of the pixels printed on card 20 can also be controlled by controlling the intensity and/or duration of heat generated by the resistive heaters 22 on thermal printhead 18.

The printing system 10 of the present invention utilizes a method of controlling the pixel levels of the pixels in the pixel array based upon proximal pixel levels to provide greater contrast in the resulting printed image. This is generally accomplished by amplifying a difference between the pixel level of the pixels in the pixel array based upon corresponding proximal pixel levels to increase or decrease the pixel levels of all or substantially all of the pixels in the array. In this manner, adjusted pixel levels are calculated for the pixels in the pixel array to form an adjusted pixel array. When the adjusted pixel array is printed, the resulting printed image is sharper and has greater contrast than that which would result from the accurate printing of the original image file.

Figure 3:
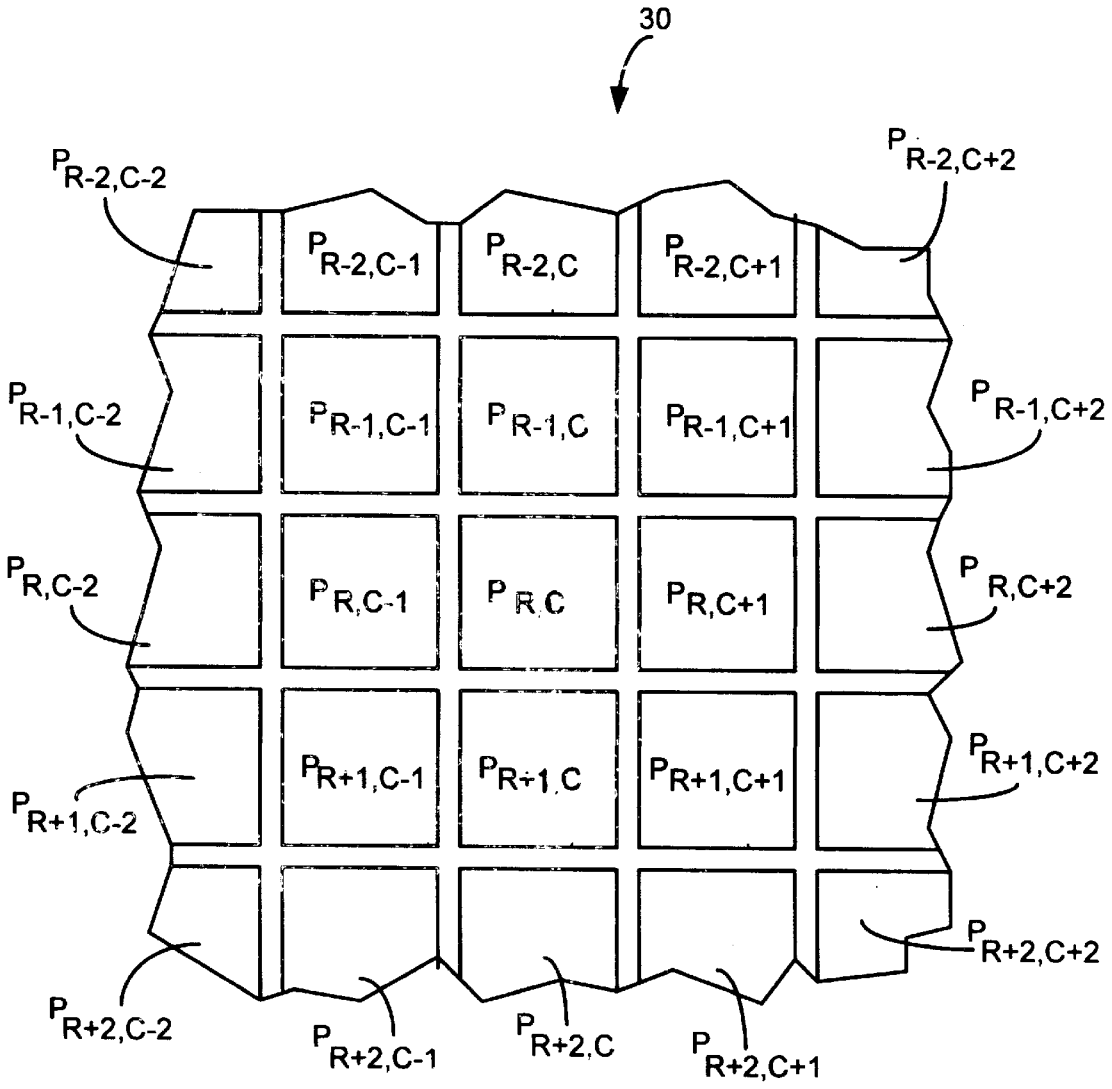
FIG. 3 is a simplified block diagram of a portion of a pixel array.

FIG. 3 shows a portion of an original pixel array 30 representing an original image to be printed. Each pixel has a pixel level designated as $P_{R,C}$, where R represents the row of the pixel and C represents the column of the pixel. To simplify the discussion of the various embodiments of the present invention, the following will describe how a pixel level of a single a pixel, $P_{R,C}$, can be adjusted to improve contrast between it and pixels proximate to it.

Figure 4:
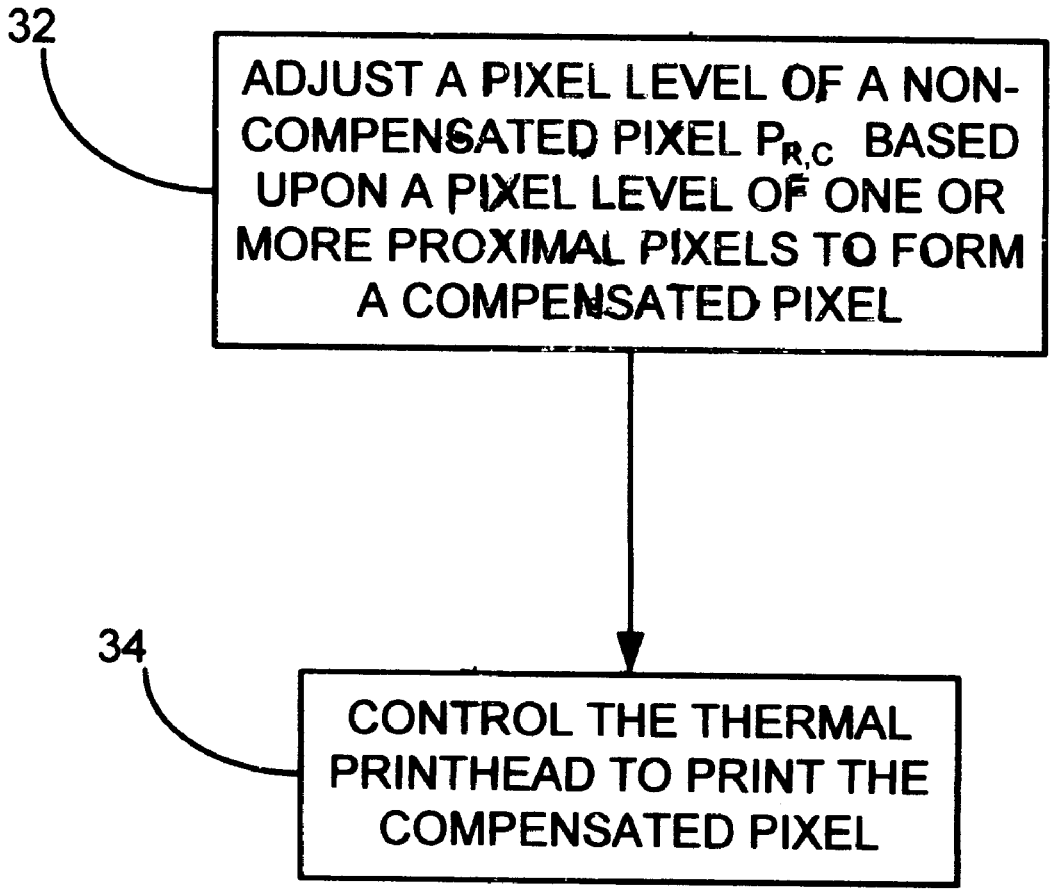
FIG. 4 is a flowchart illustrating a method of improving thermal printhead performance in accordance with embodiments of the invention.

FIG. 4 shows a flowchart of the general method of improving thermal printhead performance in accordance with one embodiment of the invention. At step 32, a pixel level of a selected pixel $P_{R,C}$ is adjusted to an adjusted or compensated pixel level based upon at least one proximal pixel level defined as the pixel level of a pixel located proximate (proximal pixel) to the selected pixel. This adjustment generally results in the amplification of the difference between the pixel levels of the selected pixel $P_{R,C}$ and the pixel level of at least one proximal pixel. Proximal pixels can be any of the pixels located in the vicinity of the selected pixel $P_{R,C}$ (FIG. 3), such as those located, for example, within two pixels of the selected pixel $P_{R,C}$. In another embodiment of the invention, the proximal pixels are selected from the pixels that are immediately adjacent to the selected pixel $P_{R,C}$. Here, the one or more proximal pixels used to adjust the pixel level of the selected pixel $P_{R,C}$ could be chosen from the following group of pixels: $P_{R-1,C-1}$; $P_{R-1,C}$; $P_{R-1,C+1}$; $P_{R,C-1}$; $P_{R,C+1}$; $P_{R+1,C-1}$; $P_{R+1,C}$; and $P_{R+1,C+1}$. In a preferred embodiment, these proximal pixels are further limited to the pixels located immediately above ($P_{R-1,C}$), below ($P_{R+1,C}$), and in front ($P_{R,C+1}$) of non-compensated pixel $P_{R,C}$.

In one embodiment of the invention, the adjustment of the selected pixel level $P_{R,C}$ is made in accordance with Eq. 1. Here, n represents the number of proximal pixels that are used to adjust the selected pixel level $P'_{R,C}$ to establish an adjusted or compensated pixel level $P'_{R,C}$. For example, in the embodiment mentioned above where the proximal pixels used to adjust the selected pixel level $P_{R,C}$ are limited to the pixels located immediately above ($P_{R-1,C}$), below ($P_{R+1,C}$), and in front ($P_{R,C+1}$) of the selected pixel, n is three. Although each of the pixel levels used to calculate the adjusted pixel level $P'_{R,C}$ in Eq. 1 is depicted as having unity gain, those skilled in the art understand that the proximal pixel levels and the selected pixel level $P_{R,C}$ could be multiplied by a scaling factor to increase or decrease the resulting amplification of the difference therebetween.

$$P'_{R,C} = \left(P_{R,C}(2n+1) - \sum_{n} \text{proximal_pixel_levels}\right) \div (n+1) \qquad \text{Eq. 1}$$

The number of proximal pixels n, which are available to adjust a pixel level $P_{R,C}$ of a selected pixel will depend, at least in part, on the location of the pixel $P_{R,C}$ within the pixel array 30. This is due to the fact that the pixels on the periphery of the pixel array 30, will not have as many proximal pixels as those located further away from the peripheral edge of the pixel array 30. As a result, the pixels $P_{R,C}$ positioned at the peripheral edge of pixel array 30 may use a different number of pixels n than are used by the pixels $P_{R,C}$ which are located away from the peripheral edge. Alternatively, the pixels located at the periphery of pixel array 30 could remain uncompensated.

In another aspect of the present invention, a value for a selected pixel $P_{R,C}$ is compensated for residual or latent heat in the heating elements as set forth in U.S. Pat. No. 5,793,403. The combination of these techniques can result in optimized printing of the pixels resulting in further improvements to image sharpness and accuracy.

Referring again to FIG. 4, the general method continues by controlling thermal printhead 18 (FIG. 1) to print the adjusted pixel onto a card 20, as indicated at step 34. The printing of the pixels is controlled by instructions from microcomputer 12 using methods which are understood by those skilled in the art. In order to simplify the discussion of the present invention, the printing of pixels will be discussed with regard to a single resistive heating element 22 (FIG. 2) of thermal printhead 18. Thus, when an adjusted pixel is printed, it should be understood that each of the resistive heating elements 22 of thermal printhead 18 will likely be printing their respective adjusted pixel thereby printing a column of adjusted pixels, corresponding to the number of heating elements 22 of printhead 18, at a time.

Figure 5:
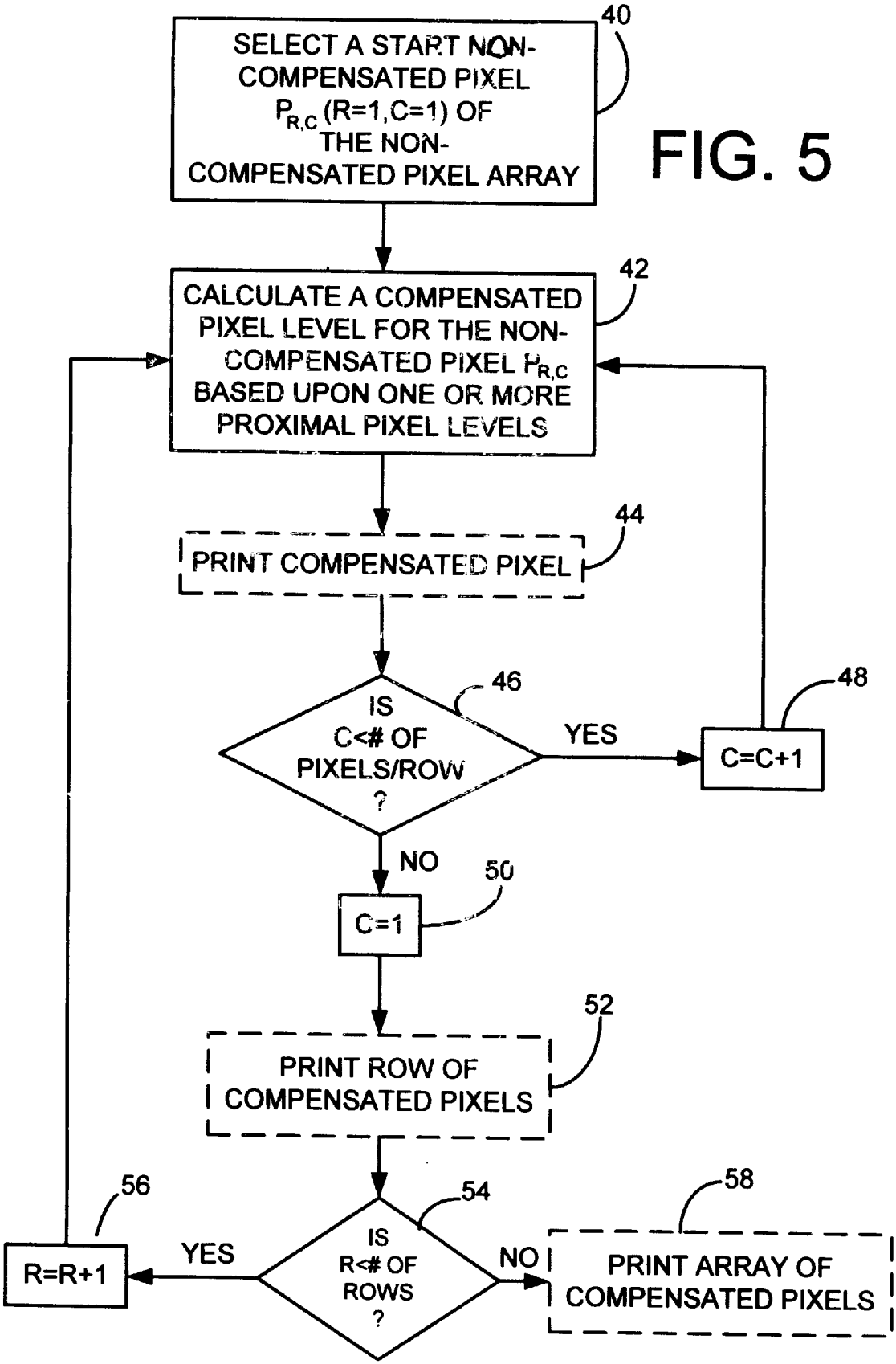
FIG. 5 is a flowchart illustrating a method of improving thermal printhead performance in accordance with various embodiments of the invention.

Alternative embodiments of the invention relate to printing an entire adjusted pixel array onto the card substrate 20. These embodiments include: printing a single pixel at a time once adjusted; printing a row of the pixels once adjusted; printing a line of the pixels once adjusted; and printing the entire adjusted pixel array once all of the pixels have been adjusted. These embodiments will be discussed with reference to the flowchart of FIG. 5. At step 40, a starting pixel of the non-compensated pixel array 30 (FIG. 3) is selected. The starting pixel could be, for example, the pixel $P_{R,C}$ located at row one (R=1) and column one (C=1), but other starting positions are possible. At step 42, the pixel level of the selected pixel $P_{R,C}$ is adjusted based on one or more proximal pixels to form an adjusted or compensated pixel in the manner discussed with regard to step 32 of the flowchart of FIG. 4. In one embodiment of the invention, the adjusted pixel can be printed prior to compensating another pixel, as indicated at optional step 44. Next, at step 46, it is determined whether all of the pixel levels of the pixels in the row R have been adjusted. If they haven't, then the column C of the pixel array is incremented by one at step 48 to select the next pixel in the row R, and the method returns to step 42. If all of the pixels in the row R have been compensated, the column C of the pixel array 30 is reset to one, at step 50.

In another embodiment of the invention, the row of pixels that have just been adjusted are printed, as indicated at optional step 52. Step 52 can replace step 44.

Next, it is determined at step 54 whether all of the rows R of the pixel array have been adjusted. If they haven't, the method moves to step 56 where the row R is incremented by one to move to the next row. Here, row R is incremented such that the resistive heating elements are positioned in line with their respective row R of the next line to be printed. Accordingly, row R is incremented by the number of resistive heating elements 22 of printhead 18 or by the number of rows of the pixel array 30 that are formed when a single line is printed by printhead 18. Once row R has been incremented, the method returns to step 42 to perform further pixel level adjustment. If all of the rows R of the pixel array have been adjusted and the printing of the adjusted pixels is complete, because either step 44 or step 52 were completed, the method ends. However, if neither of the printing steps 44 or 52 were used, the entire array of adjusted pixels or adjusted pixel array can be printed at optional step 58, typically one line of the adjusted pixel array at a time.

In summary, the present invention is directed to a method of improving the contrast of an image printed by an identification card printing system. In general, a pixel level of a selected pixel is adjusted based upon at least one pixel level of a proximate pixel to increase contrast therebetween. The present invention is further directed to an identification card printing system which utilizes the above-described method to improve contrast in images printed therewith. Although the present invention has been described with reference to preferred embodiments, workers skilled in the art will recognize that changes may be made in form and detail without departing from the spirit and scope of the invention.

What is claimed is:

1. An identification card printing system adapted to improve contrast of an original image represented by an array of pixels each having a pixel level representing an intensity of the pixel, the system comprising:

a substrate feeder mechanism adapted to transport a substrate along a printing path;

a thermal printhead in line with the printing path and having a plurality of resistive heaters arranged in a line on a substrate;

a microcomputer;

a memory; and a printer driver stored in the memory and including instructions executable by the microcomputer to perform steps of:

(a) selecting a pixel of the pixel array;

(b) calculating an adjusted pixel level for the selected pixel based upon its pixel level and at least one proximal pixel level defined as the pixel level of a pixel located proximate to the selected pixel; and (c) repeating steps (a) and (b) for substantially all of the pixels of the pixel array to form an adjusted pixel array that represents an adjusted image having greater contrast than the original image, wherein some of the adjusted pixel levels constitute increases from their previous pixel levels and some constitute decreases from their previous pixel levels.

2. The identification card printing system of claim 1, wherein the calculating step (b) is made in accordance with the relationship:

$$P'_{R,C} = \left(P_{R,C}(2n+1) - \sum_{n} \text{proximal_pixel_levels}\right) \div (n+1)$$

wherein $P'_{R,C}$ represents an adjusted pixel level for the selected pixel, $P_{R,C}$ denotes the pixel level of the selected pixel, and n represents the number of proximal pixel levels that are used to calculate the adjusted pixel level.

3. The identification card printing system of claim 1, wherein the proximal pixel level corresponds to a pixel that is adjacent to the selected pixel.

4. The identification card printing system of claim 3, wherein the proximal pixel level corresponds to a pixel selected from a group consisting of a preceding pixel, a succeeding pixel, a pixel positioned above the selected pixel, and a pixel positioned below the selected pixel.

5. A method for use with an identification card printing system to improve contrast of an original image represented by an array of pixels each having a pixel level representing an intensity of the pixel, the method comprising steps of:

(a) selecting a pixel of the pixel array;

(b) calculating an adjusted pixel level for the selected pixel based upon its pixel level and at least one proximal pixel level defined as the pixel level of a pixel located proximate to the selected pixel; and (c) repeating steps (a) and (b) for substantially all of the pixels of the pixel array to form an adjusted pixel array that represents an adjusted image having greater contrast than the original image, wherein some of the adjusted pixel levels constitute increases from their previous pixel levels and some constitute decreases from their previous pixel levels.

6. The method of claim 5, wherein the calculating step (b) is made in accordance with the relationship:

$$P'_{R,C} = \left(P_{R,C}(2n+1) - \sum_{n} \text{proximal_pixel_levels}\right) \div (n+1)$$

wherein $P'_{R,C}$ represents an adjusted pixel level for the selected pixel, $P_{R,C}$ denotes the pixel level of the selected pixel, and n represents the number of proximal pixel levels that are used to calculate the adjusted pixel level.

7. The method of claim 5, wherein the proximal pixel level corresponds to a pixel that is adjacent to the selected pixel.

8. The method of claim 7, wherein the proximal pixel level corresponds to a pixel selected from a group consisting of a preceding pixel, a succeeding pixel, a pixel positioned above the selected pixel, and a pixel positioned below the selected pixel.

9. The method of claim 5, including a step of (d) controlling a thermal printhead to print the adjusted pixel array.

* * * * *